US008963816B2

(12) United States Patent
Baik et al.

(10) Patent No.: US 8,963,816 B2
(45) Date of Patent: Feb. 24, 2015

(54) LIGHT EMITTING DISPLAY AND METHOD OF DRIVING THEREOF

(75) Inventors: Seong Ho Baik, Gunpo-si (KR); In Hwan Kim, Seoul (KR); Seung Chan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 1418 days.

(21) Appl. No.: 11/638,388

(22) Filed: Dec. 14, 2006

(65) Prior Publication Data

US 2007/0152923 A1 Jul. 5, 2007

(30) Foreign Application Priority Data

Dec. 30, 2005 (KR) ..... 10-2005-0136128

(51) Int. Cl.
*G09G 3/30* (2006.01)
*G09G 3/32* (2006.01)
*G09G 3/20* (2006.01)

(52) U.S. Cl.
CPC ..... *G09G 3/3233* (2013.01); *G09G 3/2025* (2013.01); *G09G 2300/0465* (2013.01); *G09G 2300/0842* (2013.01); *G09G 2310/0213* (2013.01); *G09G 2310/0235* (2013.01); *G09G 2330/021* (2013.01)
USPC ..... 345/78; 345/92

(58) Field of Classification Search
CPC ..... G09G 2300/0842; G09G 3/3233; G09G 2320/043; G09G 2300/0861; G09G 300/0819
USPC ..... 345/36, 39, 42, 45–46, 76–78, 82–84, 345/204, 690, 92; 315/169.3
See application file for complete search history.

(56) References Cited

U.S. PATENT DOCUMENTS

| | | | | |
|---|---|---|---|---|
| 5,748,160 | A | 5/1998 | Shieh et al. | |
| 6,618,031 | B1 * | 9/2003 | Bohn et al. | 345/83 |
| 6,747,617 | B1 * | 6/2004 | Kawashima | 345/76 |
| 7,119,770 | B2 * | 10/2006 | Moon | 345/79 |
| 7,248,245 | B2 * | 7/2007 | Adachi et al. | 345/102 |
| 7,728,798 | B2 * | 6/2010 | Kim | 345/82 |
| 7,768,482 | B2 * | 8/2010 | Kwak | 345/76 |
| 7,773,054 | B2 * | 8/2010 | Jeong | 345/76 |
| 7,804,466 | B2 * | 9/2010 | Kwak et al. | 345/76 |
| 7,812,787 | B2 * | 10/2010 | Eom | 345/45 |
| 2002/0195968 | A1 | 12/2002 | Sanford et al. | |
| 2003/0011559 | A1 | 1/2003 | Adachi et al. | |
| 2003/0128201 | A1 * | 7/2003 | Ishizuka | 345/212 |
| 2004/0056252 | A1 | 3/2004 | Kasai | |
| 2005/0104818 | A1 | 5/2005 | Kwak et al. | |
| 2005/0110723 | A1 * | 5/2005 | Shin | 345/76 |

(Continued)

FOREIGN PATENT DOCUMENTS

| | | |
|---|---|---|
| CN | 1670804 | 9/2005 |
| DE | 691 10 229 T2 | 1/1996 |

(Continued)

*Primary Examiner* — Kevin M Nguyen
*Assistant Examiner* — Mansour M Said
(74) *Attorney, Agent, or Firm* — McKenna Long & Aldridge LLP

(57) ABSTRACT

There are provided a light emitting display comprising at least a light emitting unit comprising at least two light emitting diodes which are electrically connected to the same driving unit to emit light, and a plurality of voltage sources whereby one voltage source supplies a voltage different from the other voltage(s) supplied from the other voltage source(s) to each of the light emitting diodes.

16 Claims, 10 Drawing Sheets

(56) References Cited

U.S. PATENT DOCUMENTS

| | | | | |
|---|---|---|---|---|
| 2005/0200617 | A1 | 9/2005 | Kwak et al. | |
| 2006/0284815 | A1 * | 12/2006 | Kwon et al. | 345/98 |

FOREIGN PATENT DOCUMENTS

| | | | |
|---|---|---|---|
| EP | 0 478 186 | B1 | 4/1992 |
| GB | 2 398 939 | | 9/2004 |
| JP | H09-138659 | | 5/1997 |
| JP | 2005-266773 | | 9/2005 |
| JP | 2005-326830 | A | 11/2005 |
| WO | WO 00/51103 | A1 | 8/2000 |
| WO | WO 03/052729 | | 6/2003 |

* cited by examiner

LIGHT EMITTING DISPLAY AND METHOD OF DRIVING THEREOF

This Nonprovisional Application claims priority under 35 U.S.C. §119(a) on Patent Application No. 2005-136128 filed in Korea on Dec. 30, 2005, the entire contents of which are hereby incorporated by reference for all purposes as if fully set forth herein.

BACKGROUND OF THE INVENTION

1. Field of the Invention

The present invention relates to a light emitting display and a method of driving thereof.

2. Description of the Related Art

Recently, there have been developed various flat panel displays that can reduce heavy weight and large bulk that is a disadvantage of a cathode ray tube display.

The flat panel displays include a liquid crystal display (hereinafter, referred to as a "LCD"), a field emission display (FED), a plasma display panel (hereinafter, referred to as a "PDP"), an electro-luminescence (hereinafter, referred to as an "EL") display or light emitting display, etc.

The light emitting displays are largely classified into an inorganic light emitting display (hereinafter, referred to as an "LED") and an organic light emitting display (hereinafter, referred to as an "OLED") depending on a material of a light emitting layer. Light emitting displays have a fast response speed and high light emitting efficiency, brightness, and broad viewing angle as a self-luminant element. An organic light emitting display (OLED) has advantages of a low DC driving voltage, uniformity of emitted light, easy pattern formation, good light emitting efficiency in comparison with other light emitting elements, all color emission in a visible region, etc.

Furthermore, the organic light emitting diode (OLED) is classified into a passive matrix organic light emitting display (PMOLED) and an active matrix organic light emitting display (AMOLED) depending on a driving method.

FIG. 1 is a circuit diagram illustrating a part of a related art active matrix organic light emitting display.

As illustrated in FIG. 1, the related art active matrix organic light emitting display 100 is largely divided into a driving unit 102, a light emitting unit 104 and a voltage source VDD.

Specifically, the driving unit 102 of the related art active matrix organic light emitting display 100 is electrically connected to a data line 106 and a scan line 108. The light emitting unit 104 includes one light emitting diode that emits a specific color light. The light emitting unit 104 is driven by one driving unit 102.

The voltage source VDD supplies the same voltage to the light emitting units 104 of all pixels. The same voltage should be satisfied with the light emitting units, which have low emitting efficiency. Therefore, because the light emitting units of high emitting efficiency are supplied unnecessarily high voltages, power consumption is increased and the driving transistor 102 is deteriorated, so a lifetime of the OLED is reduced.

SUMMARY OF THE INVENTION

Accordingly, the present invention is directed to a light emitting display and method of driving thereof that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

According to an aspect of the present invention, there is provided a light emitting display comprising: a driving unit being electrically connected to a data line and a scan line; a light emitting unit comprising at least two light emitting diodes which are electrically connected to the same driving unit to emit a light; a plurality of voltage sources whereby one voltage source supplies a voltage different from the other voltage(s) supplied from the other voltage source(s) to each of the light emitting diodes; and a selection unit between the voltage sources and the light emitting diodes and selectively connecting the light emitting diodes to the voltage sources.

According to another aspect of the present invention, there is provided a light emitting display comprising: a driving unit being electrically connected to a data line and a scan line; a light emitting unit comprising at least two light emitting diodes electrically connected to the same driving unit to emit light; a plurality of ground sources whereby one ground source supplies a ground voltage different from the other ground source(s) supplied from the other ground source(s) to each of the light emitting diodes; and a selection unit between the ground sources and the light emitting diodes and selectively connecting the light emitting diodes to the ground sources.

According to another aspect of the present invention, there is provided a method of driving an light emitting display comprising: sequentially supplying a data signal through a data line depending on a scan signal that is sequentially supplied through a scan line to a driving unit; and selectively and sequentially supplying different voltages from different voltage sources respectively to each of at least two light emitting diodes electrically connected to the same driving unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
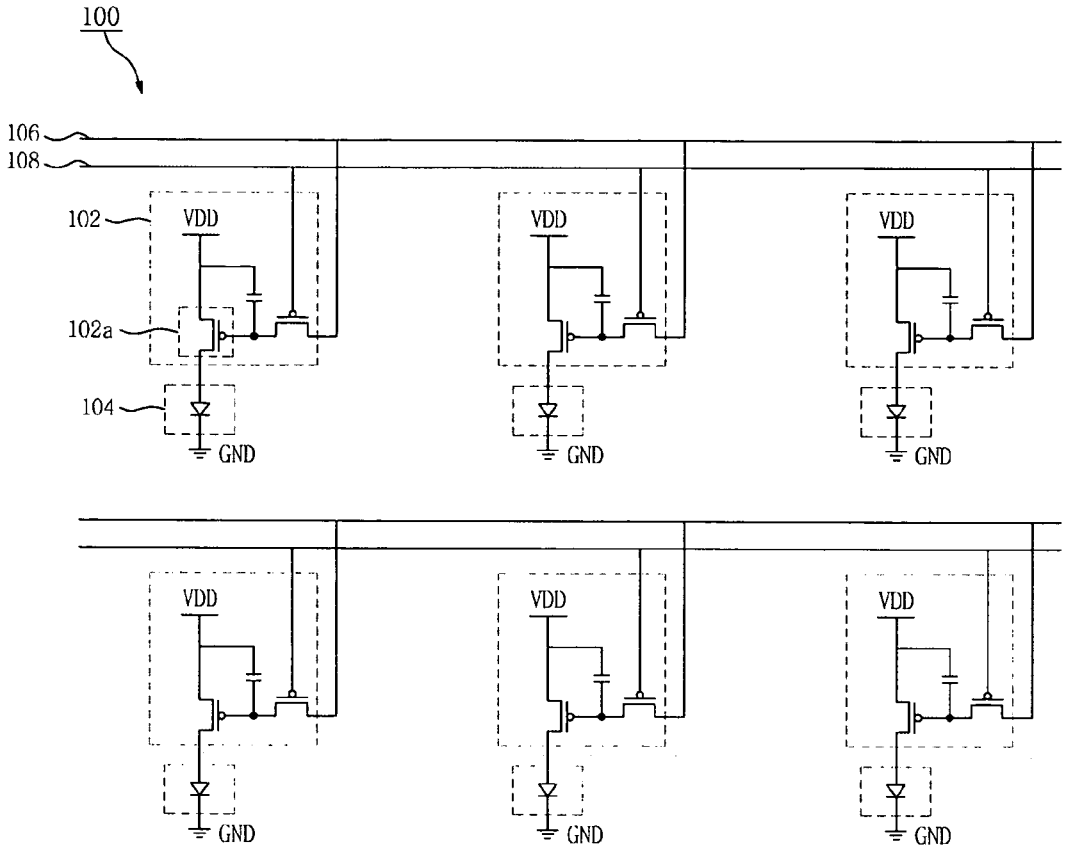
FIG. 1 is a circuit diagram illustrating a related art active matrix organic light emitting display.
Figure 2:
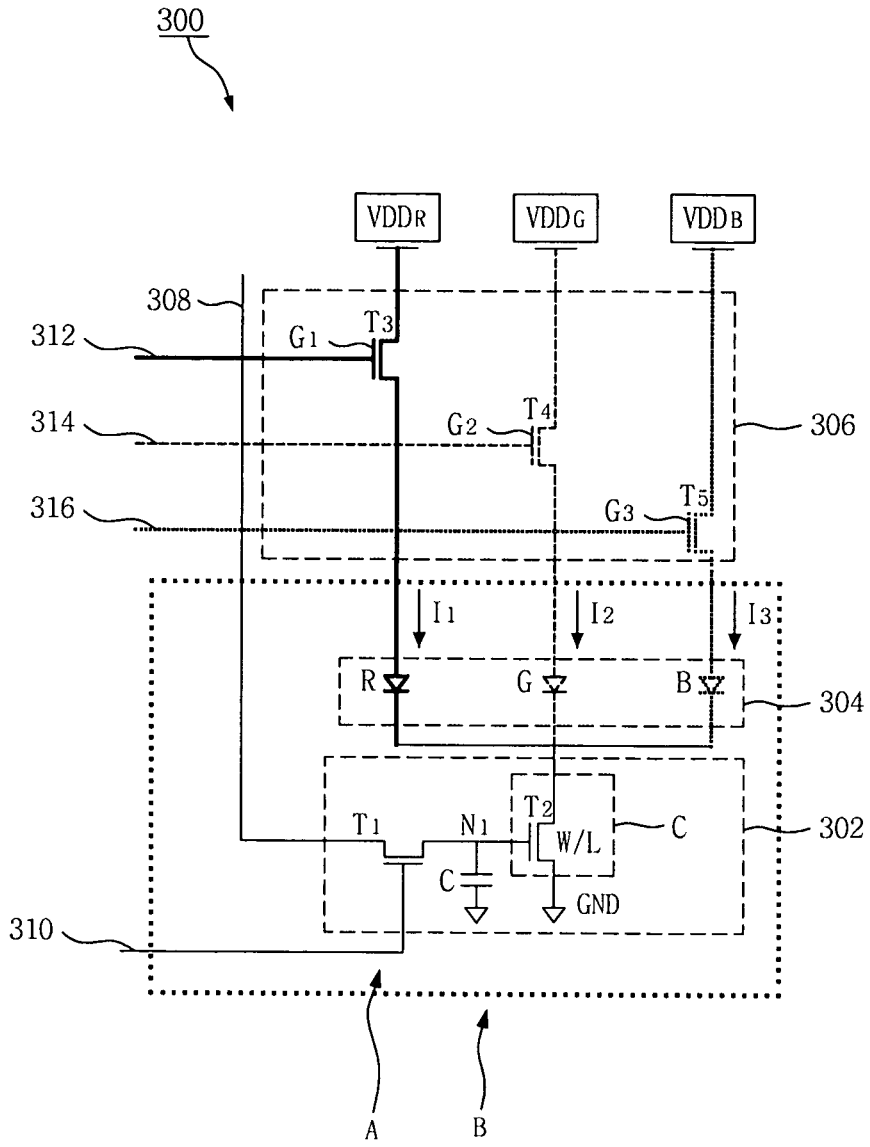
FIG. 2 is a circuit diagram illustrating an active matrix light emitting display according to an embodiment of the present invention.

As illustrated in FIG. 2, an active matrix light emitting display 300 comprises a driving unit 302, three voltage sources $VDD_R$, $VDD_G$, $VDD_B$, a light emitting unit 304, and a selection unit 306.

The driving unit 302 of the active matrix light emitting display 300 is electrically connected to a data line 308 and a scan line 310. The driving unit 302 includes a switching transistor T1 and a driving transistor T2.

The switching transistor T1 and the driving transistor T2 of the driving unit 302 are n-type MOS thin film transistors. However, the present invention is not limited thereto and thus the switching transistor T1 and the driving transistor T2 of the driving unit 302 may be p-type MOS thin film transistors. Also, each of the switching transistor T1 and the driving transistor T2 of the driving unit 302 may selectively be one of a p-type or a n-type MOS transistor depending on circuit arrangement and manufacture process.

When a scan signal is supplied to the switching transistor T1 through the scan line 310, the switching transistor T1 is turned on and a data signal is supplied to a first node N1 or a gate terminal of the driving transistor T2. The data signal that is supplied to the first node N1 is charged to a capacitor C and driving transistor T2 is turned on to make current flow from the voltage sources to the ground.

For the purposes of explaining the exemplary embodiment, the light emitting unit 304 of the active matrix light emitting display 300 includes three light emitting diodes R, G, B corresponding to one pixel. However, the number of the light emitting diodes may be two or more and not limited to three.

Furthermore, three light emitting diodes corresponding to the above-described one pixel comprise R, G, and B diodes for emitting different color light. If the number of the light emitting diodes corresponding to the above-described one pixel is four, four light emitting diodes may be R, G, B, and W diodes for emitting different color light.

Also, in order to compensate a color of the light emitting diode, the number of the light emitting diodes may be 5 or more. In this case, the light emitting diodes may be arranged in arrangement of R GG BB or R GG BBB diodes.

In addition, as appropriate, the light emitting diodes may be of colors other than red, green, blue, and white.

The plurality of light emitting diodes R, G and B of the light emitting unit 304 include an electron injection electrode, a hole injection electrode and an emitting layer. The emitting layer may be made from an organic or an inorganic compound formed between the electron injection electrode and the hole injection electrode. When an electron is injected into the emitting layer, the injected electron and the injected hole are paired together. The extinction of the injected hole-electron pair results in electroluminescence.

At this time, each of three voltage sources $VDD_R$, $VDD_G$, and $VDD_B$ is electrically connected to each of three light emitting diodes R, G and B. Each of three voltage sources supplies a voltage different from each other to each of the light emitting diodes R, G and B.

Each of R, G, and B diodes has a threshold voltage different from each other because of the emitting characteristics different from each other. If an emitting diode, for example, B diode of three emitting diodes, has high threshold voltage, voltage source $VDD_B$ supplies high voltage to it. Otherwise, if the other emitting diode, for example, G diode of three emitting diodes, has relatively low threshold voltage, voltage source $VDD_G$ supplies relatively low voltage to it.

Figure 3:
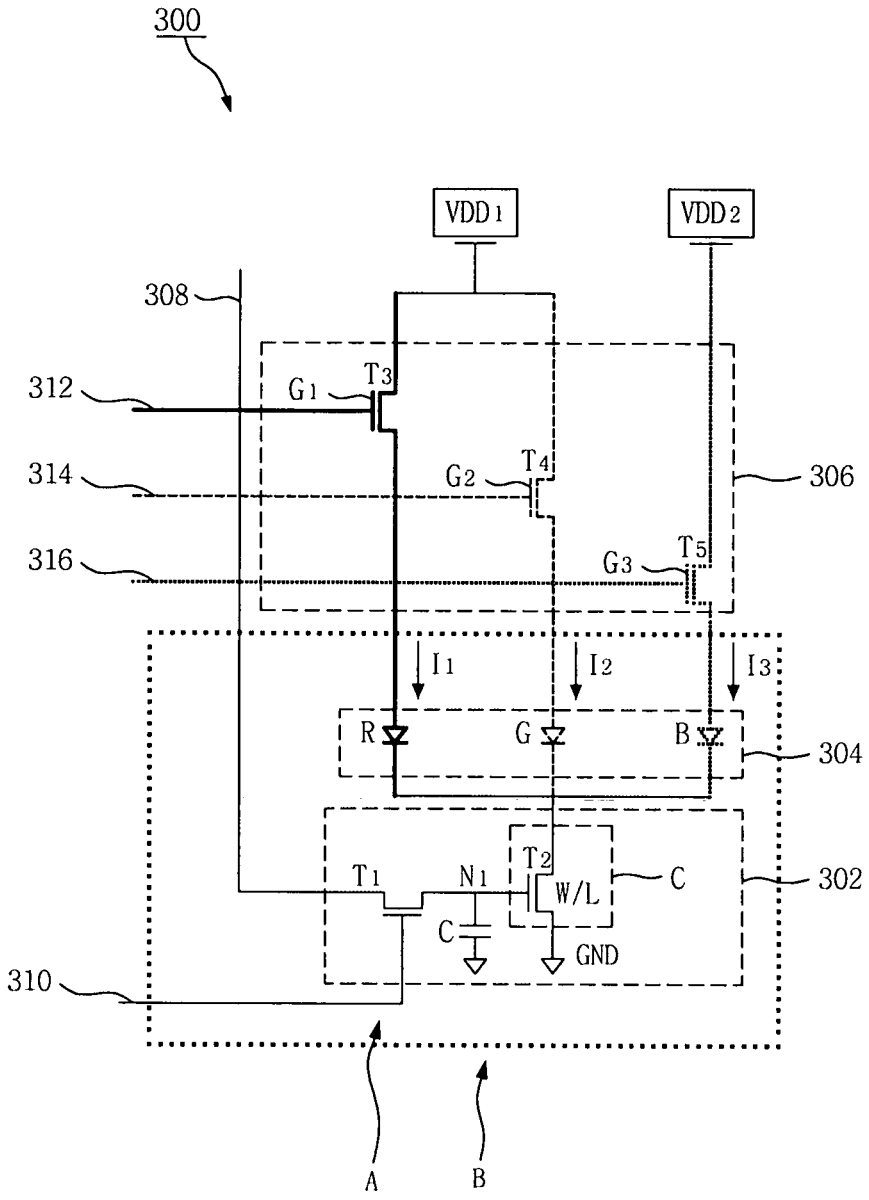
FIG. 3 is a circuit diagram illustrating a driving unit, a light emitting unit and three voltage sources of the active matrix organic light emitting display according to another embodiment of the present invention.

Also, one voltage source may supply a voltage different from the other voltage sources to each of the light emitting diodes R, G and B. As illustrated in FIG. 3, the same voltage source may supply the same voltage to two emitting diodes R and G, and the different voltage source may supply the different voltage to a remaining emitting diode B. Because threshold voltage of R diode is similar to threshold voltage of G diode, and threshold voltage of B diode is different from them.

As illustrated in FIG. 2, the selection unit 306 is located between the voltage sources $VDD_R$, $VDD_G$, and $VDD_B$ and the light emitting diodes R, G and B. The selection unit 306 selectively connects the light emitting diodes R, G and B to the voltage sources $VDD_G$, and $VDD_B$.

The selection unit 306 includes three transistors T3, T4, and T5, and three selection lines 312, 314 and 316.

Each of three transistors T3, T4, and T5 is located between each of the respective voltage sources $VDD_R$, $VDD_G$, and $VDD_B$ and each of the respective light emitting diodes R, G and B.

Three transistors T3, T4, and T5 of the selection unit 306 are n-type MOS thin film transistors. However, the present invention is not limited thereto and thus three transistors T3, T4, and T5 of the selection unit 306 may be p-type MOS thin film transistors. Also, each of three transistors T3, T4, and T5 of the selection unit 306 may selectively be one of a p-type or a n-type MOS thin film transistor depending on circuit arrangement and manufacture process.

Each of three selection lines 312, 314 and 316 is connected to each of respective gates G1, G2, and G3 for three respective transistors T3, T4, and T5. Three selection signals are sequentially supplied to three gates G1, G2, and G3 for three transistors T3, T4, and T5. Therefore, three transistors T3, T4, and T5 are sequentially turned on and source voltages are sequentially supplied from three voltage sources to three light emitting diodes R, G and B.

The light emitting display 300 has a top-emission type DOD structure, in which the driving unit 302 and the light emitting unit 304 are formed on each of the separated substrates and one of two separated substrates is attached to the other of them. But the present invention is not limited thereto. The driving unit 302 and the light emitting unit 304 of the light emitting display 300 may be formed on the same substrate and may be sealed by the protector such as the metal cap, the glass can, the protecting film or the hybrid of them.

The driving unit 302 and the light emitting unit 304 of the active matrix light emitting display 300 may be formed in the active region A. The selection unit 306 and the plurality of voltage sources $VDD_R$, $VDD_G$, and $VDD_B$ are formed in a non-active region B.

Although arrangement of elements for the light emitting display 300 is illustrated in FIG. 2, the present invention is not limited thereto and arrangement thereof may be changed depending on the needs or the requirements for a light emitting display.

A method of driving an active matrix light emitting display according to an embodiment of the present invention will be described in detail with reference to FIGS. 4 to 6.

Figure 4:
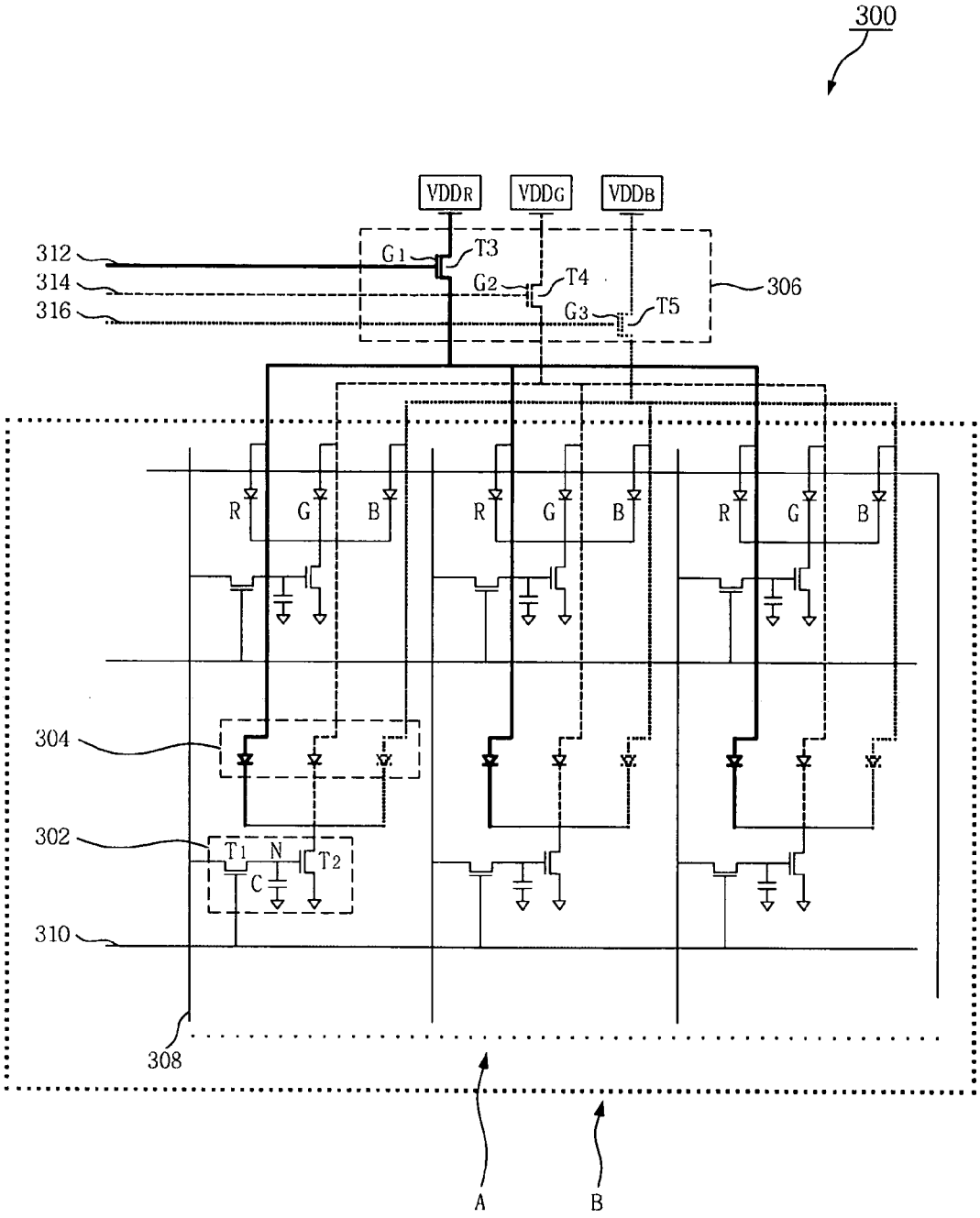
FIG. 4 is a circuit diagram illustrating the active matrix light emitting display of FIG. 2.

As illustrated in FIG. 4, the active matrix light emitting display 300 comprising the plurality of pixels M×N. Each of the pixels M×N comprises the driving unit 302 and the light emitting unit 304, respectively. Each of the driving units 302 is located at and intersection of the data line 308 and the scan line 310. The light emitting unit 304 includes three emitting diodes R, G and B. Three emitting diodes R, G and B are electrically connected to the same driving unit 302.

All of the R diodes for all kinds of pixels are electrically connected to the same voltage source $VDD_R$. All of the G diodes for all kinds of pixels are electrically connected to the same voltage source $VDD_G$. All of the B diodes for all kinds of pixels are electrically connected to the same voltage source $VDD_B$.

The selection unit 306 is located between the voltage sources $VDD_R$, $VDD_G$ and $VDD_B$, and the light emitting diodes R, G and B. The selection unit 306 selectively connects both of them depending on the selection signals through the selection lines 312, 314 and 316.

Also, the light emitting display 300 comprises a controller, a scan driver, a data driver (not shown). The controller is supplied the image data from the exterior image device such as video device. The controller generates control signals according to the image data. The control signals are supplied to the scan driver, the data driver, and the voltage sources $VDD_R$, $VDD_G$, and $VDD_B$. The scan driver supplies scan signals to the switching transistor T1 through the scan lines 310 according to the control signals. The data driver supplies data signals to the gate of the driving transistor T2 through data lines 308.

The scan signals and the data signals may be synchronized by the controller. The voltage sources $VDD_R$, $VDD_G$, and $VDD_B$ supply the voltages to three emitting diodes R, G and B through voltage lines according to control signals from the controller, synchronized with the data signals or the scan signals by the controller.

When the scan signals 310 are supplied to the switching transistors T1 through the scan lines 310, the switching transistors T1 are turned on and data signals are supplied to the first nodes N1 or the gates of the driving transistors T2.

The data signals that are supplied to the first nodes N1 are charged to the capacitors C and the driving transistors T2 are turned on to make current flow from the voltage sources $VDD_R$, $VDD_G$, and $VDD_B$ to the ground GND.

Figure 5:
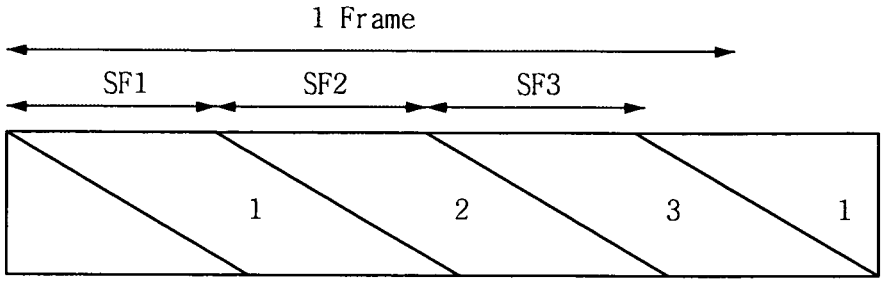
FIG. 5 is a view illustrating subfields depending on one frame for driving the active matrix light emitting display of FIG. 4.
Figure 6:
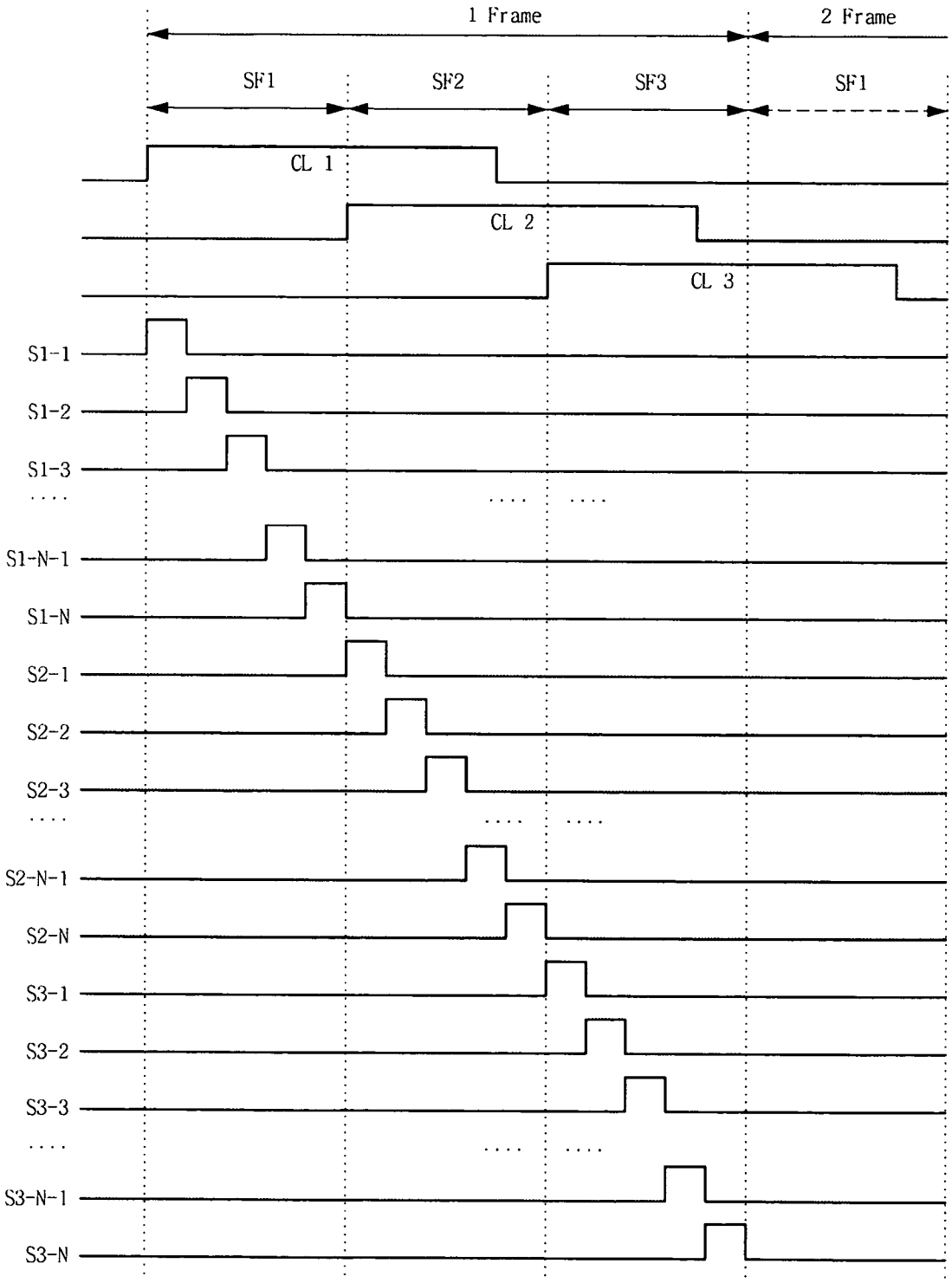
FIG. 6 is a waveform diagram illustrating a selection signal for driving the active matrix light emitting display of FIG. 4.

As illustrated in FIGS. 5 and 6, one frame may be divided into three subfields SF1, SF2, and SF3 corresponding to three subpixels or three light emitting diodes R, G and B.

In the first subfield SF1, the positive scan signals $SL_1$ to $SL_N$ are sequentially supplied to the switching transistors T1 from the red light emitting diode R of the first row to the red light emitting diode R of the N-th row through the scan lines 310. The data signals have amplitude depending on a brightness value with positive polarity and are simultaneously supplied to the gate of the driving transistors T2 from the first row to the N-th row through data lines 308, synchronized with the scan signals.

In the first subfield SF1, the first selection signals CL1 is supplied to the gates G1 of the third transistor T3 through the selection line 312, synchronized with the scan signals supplied to the gate of the driving transistors T2 from the first row to the N-th row through data lines 308. The first selection signal is provided for a respective color of light emitting diode during a respective subfield SF1 and a part of next subfield SF2 as shown in FIG. 6.

Even if the switching thin film transistors T1 are turned off, data signals are charged to the capacitors C until data signals of the second subfield SF2 are supplied, thereby maintaining emitting light for the plurality of red light emitting diodes R.

Figure 7:
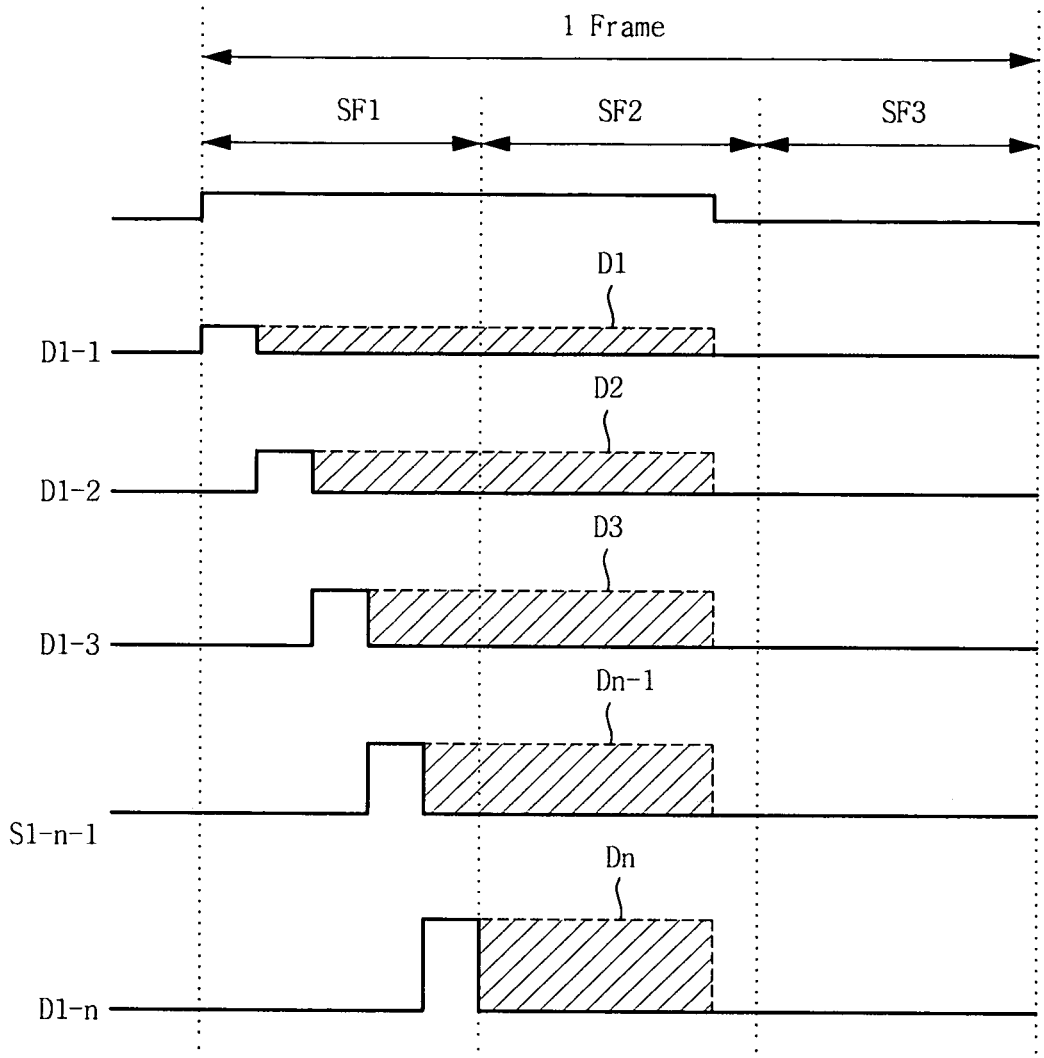
FIG. 7 is a view illustrating subfields depending on one frame for driving the active matrix light emitting display of FIG. 6.

If the scan signals are sequentially input, then as the lower scan signals are sequentially input, so the amplitude of the data signal gradually increases because the duration of emitting light according to the lower scan signal is shorter than it is according to the higher scan signal. In reference to FIG. 7, the amplitudes of the K-th data signal and the (K+1)-th data signal are equal to the formulas below.

$$D_k = \frac{nDu}{2n-k}$$

$$D_{k+1} = \frac{nDu}{2n-(k+1)}$$

Here, $D_k$ and $D_{k+1}$ are the amplitudes of the the K-th data signal and the (k+1)-th data signal, n is the total number of the scan signals, $D_u$ is the amplitude of the unit of the data signal.

Therefore, the amplitude of the last data signal is equal to the amplitude of the unit of the data signal.

In the second and the third fields SF2 and SF3, the same processes as the first field SF1 are performed, however, positive scan signals $SL_1$ to $SL_N$ are sequentially supplies to the switching transistors T1 from the green and the blue light emitting diodes G and B of the first row to the red light emitting diode R of the N-th row through the scan lines 310.

Also, in the second and the third subfield SF2 and SF3, the second selection signal CL2 and the third selection signal CL3 are respectively supplied to the gates G1 of the fourth and the fifth T4 and T5 through the other selection lines 314 and 316, synchronized with the scan signals supplied to the gate of the driving transistors T2 from the first row to the N-th row through data lines 308. The second and the third selection signals are provided for a respective color of light emitting diodes during a respective subfield and a part of next subfield as shown in FIG. 6.

Even if the switching thin film transistors T1 are turned off, data signals are charged to the capacitors C until data signals of the third field SF2 and the first field of the next frame are respectively supplied, thereby maintaining emitting light for the plurality of green and blue light emitting diodes G and B.

Because only one driving unit 302 drives three light emitting diodes R, G and B of light emitting unit 304 per one pixel to which three voltages different from each other are supplied respectively, a width W/L of the driving transistors of the driving unit 302 can be increased and thus a threshold voltage $V_{GS}$ of the driving transistors can be decreased.

Also, power consumption can be decreased and a deterioration of a driving transistor for supplying a driving current can be minimized, thereby extending a lifetime of the driving transistor.

Figure 8:
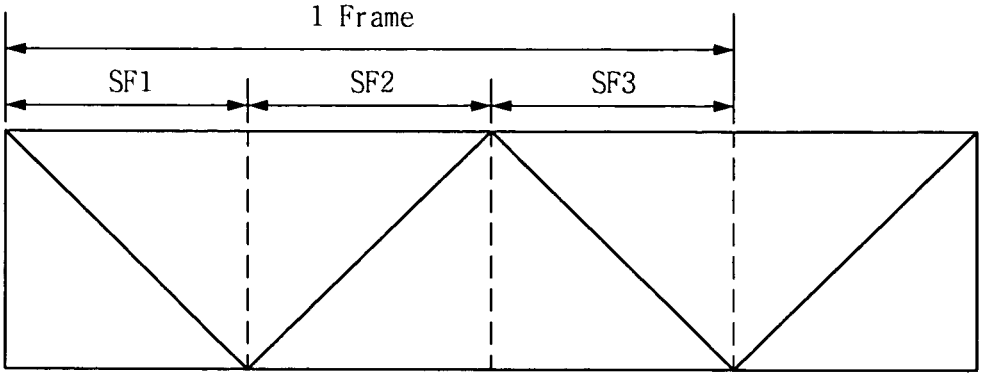
FIG. 8 is another view illustrating subfields depending on one frame for driving the active matrix light emitting display of FIG. 4.
Figure 9:
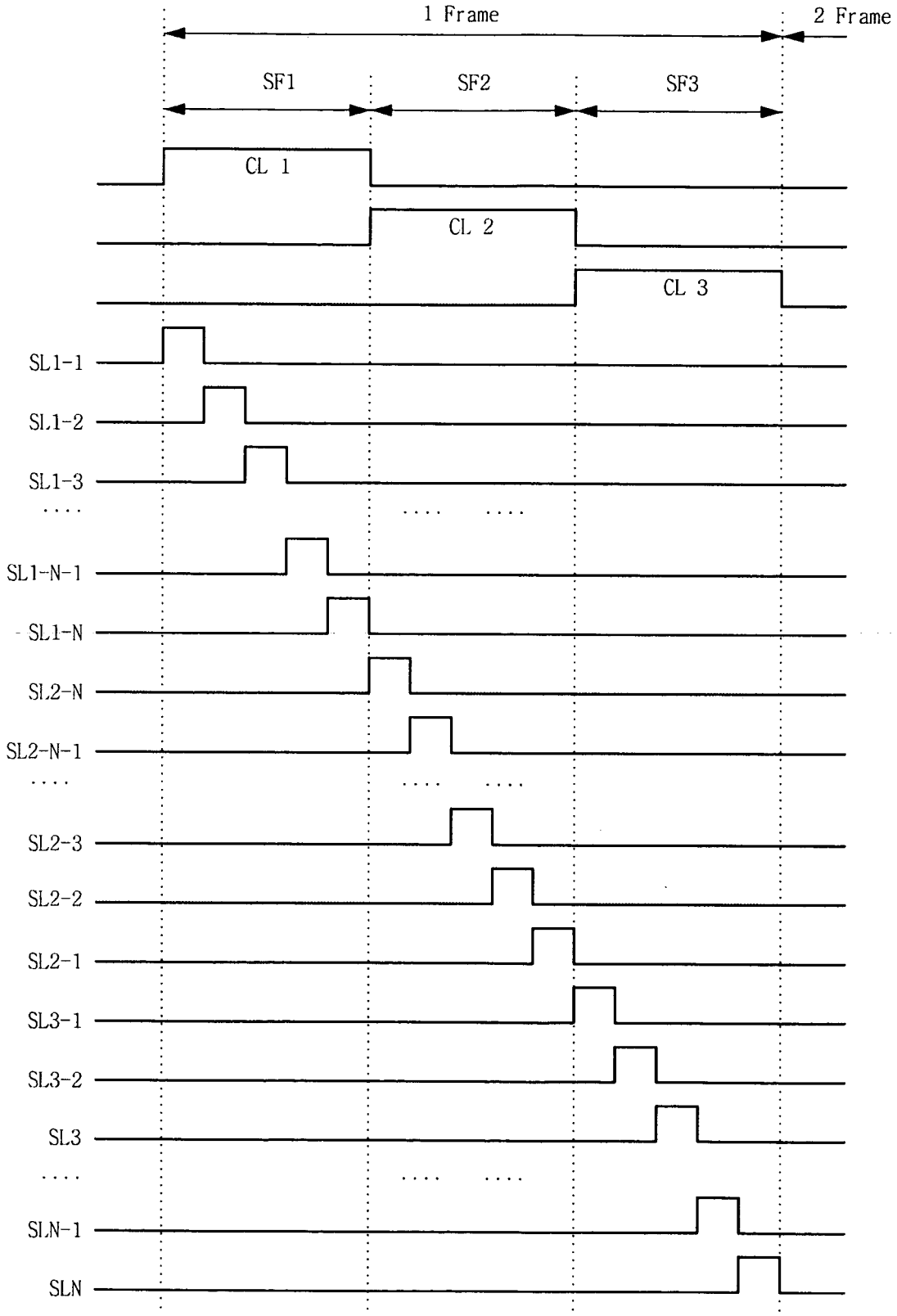
FIG. 9 is another waveform diagram illustrating a selection signal for driving the active matrix light emitting display of FIG. 4.

In reference with FIGS. 8 and 9, each of the first to the third selection signals CL1 to CL3 is first occurrence input substantially only during each of the first to the third subfields SF1 to SF3, respectively. The scanning directions are changed in turn for each of the subfields. For example, the scanning direction in the first subfield SF1 of the specific frame is downward. The scanning direction in the second subfield SF2 of the same frame is upward. The scanning directions in the third subfield SF3 of the same frame and the first subfield SF1 of the next frame is downward and upward.

Figure 10:
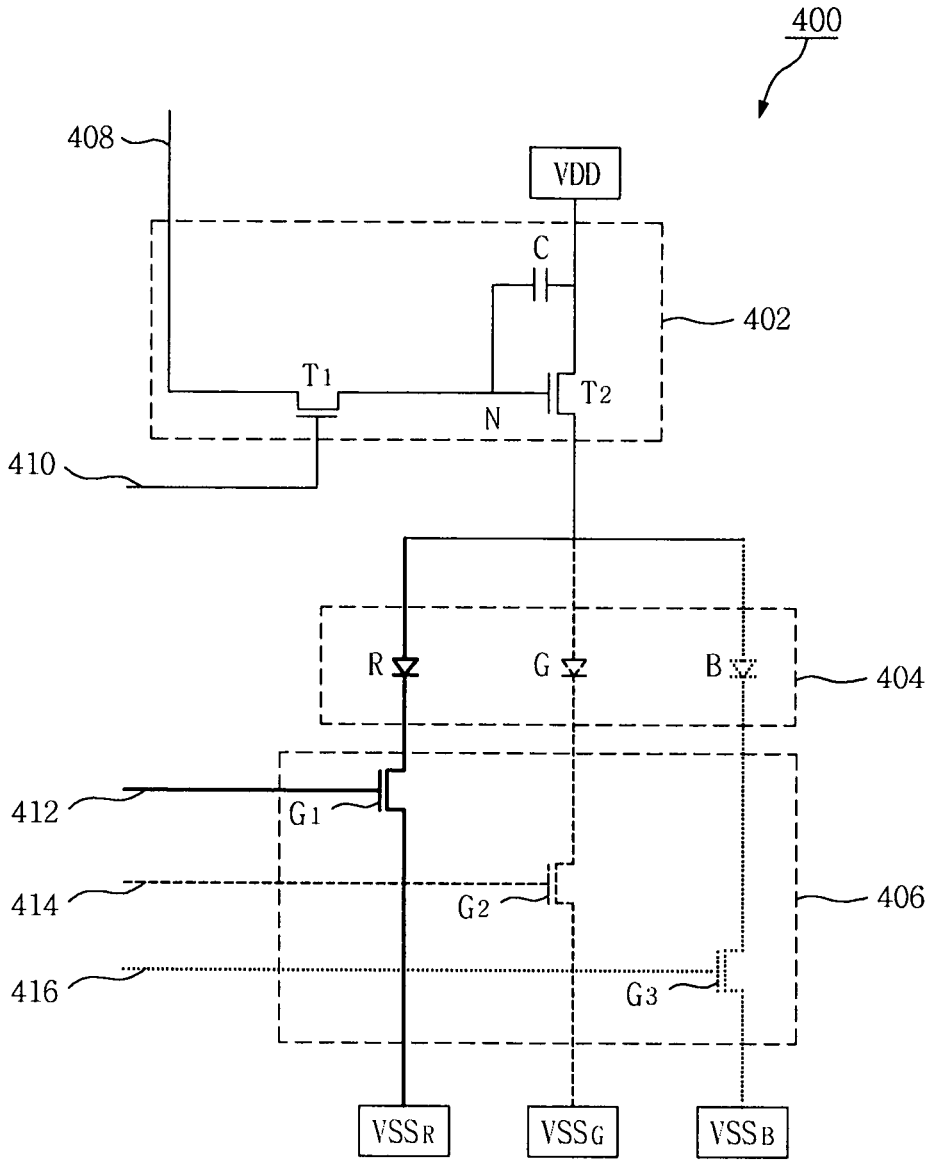
FIG. 10 is a circuit diagram illustrating an active matrix light emitting display according to another embodiment of the present invention.

As illustrated in FIG. 10, an active matrix light emitting display 400 according to another embodiment of the present invention comprises a driving unit 402, a common voltage sources VDD, a light emitting unit 404, a selection unit 406, three ground sources $VSS_R$, $VSS_G$, and $VSS_B$. The description provided above in reference with FIG. 2 is omitted with respect to the present embodiment for the sake of brevity.

The driving unit 402 of the active matrix light emitting display 400 is electrically connected to a data line 408 and a scan line 410. The driving unit 402 includes a switching transistor T1 and a driving transistor T2. The switching transistor T1 and the driving transistor T2 of the driving unit 402 may be p-type MOS thin film transistors.

The light emitting unit 404 of the active matrix light emitting display 400 includes three light emitting diodes R, G, B corresponding to one pixel. For example, three light emitting diodes corresponding to the above-described one pixel comprise R, G, and B diodes for emitting different color light. Each of three light emitting diodes is located between the same driving transistor T2 and each of three ground sources $VSS_R$, $VSS_G$, and $VSS_B$.

At this time, each of three ground sources $VSS_R$, $VSS_G$, and $VSS_B$ is electrically connected to respective ones of three light emitting diodes R, G and B. Each of three ground sources $VSS_R$, $VSS_G$, and $VSS_B$ supplies each of three ground voltages different from each other to each respective light emitting diode R, G and B.

The selection unit 406 is located between the ground sources $VSS_R$, $VSS_G$, and $VSS_B$ and the light emitting diodes R, G and B. The selection unit 406 selectively connects the light emitting diodes R, G and B to the voltage sources $VDD_R$, $VDD_G$, and $VDD_B$.

The selection unit 406 comprises three transistors T3, T4, and T5, and three selection lines 412, 414 and 416. Three transistors T3, T4, and T5 of the selection unit 306 are p-type MOS thin film transistors.

Each of three selection lines 412, 414 and 416 is connected to each of gates G1, G2, and G3 for three transistors T3, T4, and T5. Three selection signals are sequentially supplied to three gates G1, G2, and G3 for three transistors T3, T4, and T5. Therefore, each of three transistors T3, T4, and T5 is sequentially turned on and each of ground sources sequentially supplied each of three ground voltages different from each to each three light emitting diodes R, G and B.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light emitting display, comprising:

a driving unit including a switch transistor and a driving transistor and being electrically connected to a data line and a scan line;

a light emitting unit comprising at least three light emitting diodes which are electrically connected to the same driving unit to emit a light;

a plurality of voltage sources, wherein a first voltage source supplies a first voltage to two of at least three light emitting diodes electrically connected to the same driving unit, and a second voltage source supplies a second voltage different from the first voltage to a remaining light emitting diode of the at least three light emitting diodes electrically connected to the same driving unit; and a selection unit including first and second switches connected between the first voltage source and the two light emitting diodes to selectively connect the two light emitting diodes having first and second threshold voltages that are similar to each other to the first voltage source, and a third switch connected between the second voltage source and the remaining light emitting diode having a third threshold voltage that is different from the first and second threshold voltages to selectively connect the remaining light emitting diode to the second voltage source, wherein the first to third switches in the selection unit are respectively connected to first to third selection lines to receive first to third selection signals in which at least two of the first to third selection signals overlap with each other during a frame interval, wherein the first and the second voltage sources are electrically and selectively connected to the three light emitting diodes of the light emitting unit that are electrically connected to the driving transistor of the driving unit, and wherein the driving unit and the light emitting unit are formed in an active region of the light emitting display, and the plurality of voltage sources and the selection unit are formed in a non-active region.

2. The light emitting display of claim 1, wherein the selection unit includes at least one transistor between each of the voltage sources and one of the light emitting diodes.

3. The light emitting display of claim 1, wherein the light emitting unit comprises three light emitting diodes each of which emits one of red, green and blue light and is electrically connected to one of at least two of the voltage sources.

4. The light emitting display of claim 1, wherein the light emitting diodes are organic light emitting diodes.

5. The light emitting display of claim 1, wherein a selection unit sequentially connects the light emitting diodes to the voltage sources.

6. A method of driving a light emitting display, comprising;

sequentially supplying a data signal through a data line depending on a scan signal that is sequentially supplied through a scan line to a driving unit having a switching transistor and a driving transistor; and selectively supplying a first voltage to at least two light emitting diodes electrically connected to the same driving unit by at least two switches and having first and second threshold voltages that are similar to each other, and supplying a second voltage different from the first voltage to at least one light emitting diode electrically connected to the same driving unit by at least one switch and having a third threshold voltage that is different from the first and second threshold voltages, wherein said selectively supplying the first and second voltages further includes supplying first and second selection signals to the at least two switches and a third selection signal to the at least one switch in which at least two of the first to third selection signals overlap with each other during a frame interval, wherein the first and the second voltages are electrically and selectively connected to the at least two light emitting diodes and the at least one light emitting diode that are electrically connected to the driving transistor of the driving unit, and wherein the driving unit and the light emitting diodes are formed in an active region of the light emitting display, and the voltage sources and the switches are formed in a non-active region.

7. The method of claim 6, wherein the light emitting diodes comprise three light emitting diodes each of which emits one of red, green and blue light and are electrically connected to one of at least two of the different voltage sources.

8. The method of claim 7, wherein the voltages of three voltage sources supplied to three emitting diodes are different from each other.

9. The method of claim 6, wherein the light emitting diodes are organic light emitting diodes.

10. The method of claim 6, further comprising:

providing a selection signal for a respective color of light emitting diode substantially during a respective subfield and a part of next subfield, wherein a frame includes a subfield for each respective color of light emitting diode; and wherein the amplitude of the K-th data signal is substantially defined by the equation:

$$D_k = \frac{nDu}{2n-k}$$

wherein the $D_k$ is amplitude of k-th data signal, n is a total number of the scan signals, and $D_u$ is amplitude of unit of the data signal.

11. The method of claim 10, wherein amplitude of a last-supplied data signal is equal to the unit data signal.

12. The method of claim 6, further comprising:

providing a selection signal for a respective color of light emitting diode substantially only during a respective subfield, wherein a frame includes a subfield for each respective color of light emitting diode; and wherein the scan signals are provided to a plurality of the scan lines for a respective color of light emitting diodes sequentially in a first scan direction in a first frame, and the plurality of the scan lines for the respective color in a second scan direction in a second frame.

13. The method of claim 12, wherein the scan signals are supplied in a first direction for a first subfield and in a second direction for a second subfield subsequent to the first subfield of the same frame.

14. The method of claim 13, wherein the scan signals for a third subfield subsequent to the second subfield of the same frame are supplied in the first direction.

15. The method of claim 14, wherein one of the first and second direction is upward and the other of the first and second direction is downward.

16. The method of claim 13, wherein scan signals for a last subfield of a first frame are supplied in a first direction and scan signals for a first subfield of a second frame are supplied in a second direction, wherein the first direction is opposite the second directions.

* * * * *